US007222620B2

(12) United States Patent
Wolter et al.

(10) Patent No.: US 7,222,620 B2
(45) Date of Patent: May 29, 2007

(54) LIGHT FOR COOKING APPARATUS

(75) Inventors: Patrick J. Wolter, Holland, MI (US); Gregory A. Matheson, Grand Rapids, MI (US)

(73) Assignee: A & L Assembly, LLC, Vermontville, MI (US)

( * ) Notice: Subject to any disclaimer, the term of this patent is extended or adjusted under 35 U.S.C. 154(b) by 121 days.

(21) Appl. No.: 10/974,113

(22) Filed: Oct. 27, 2004

(65) Prior Publication Data

US 2005/0155597 A1 Jul. 21, 2005

Related U.S. Application Data

(60) Provisional application No. 60/537,878, filed on Jan. 21, 2004.

(51) Int. Cl.
*F24B 3/00* (2006.01)

(52) U.S. Cl. ..... 126/39 BA; 126/25 R; 126/213; 362/92

(58) Field of Classification Search ..... 362/92; 126/39 BA, 25 R, 213
See application file for complete search history.

(56) References Cited

U.S. PATENT DOCUMENTS

| | | | | |
|---|---|---|---|---|
| 2,129,339 | A | 9/1938 | Turner | |
| 2,470,645 | A | 5/1949 | Reichart | |
| 2,644,882 | A | 7/1953 | Voda | |
| 2,809,282 | A | 10/1957 | Cripe et al. | |
| 3,291,114 | A | 12/1966 | Metcalf | |
| 3,992,618 | A | 11/1976 | Matthews et al. | |
| 4,855,881 | A | 8/1989 | Pence | |
| 5,169,226 | A * | 12/1992 | Friedman | 362/190 |
| 5,257,169 | A | 10/1993 | Walendziak | |
| D366,711 | S | 1/1996 | Clasby | |
| 5,541,822 | A * | 7/1996 | Bamber | 362/190 |
| D383,235 | S | 9/1997 | Murch, Sr. | |
| 5,664,875 | A | 9/1997 | Hegedus | |
| 5,685,421 | A * | 11/1997 | Gilmore | 206/216 |
| 5,699,943 | A * | 12/1997 | Schaefer et al. | 224/197 |
| D412,591 | S | 8/1999 | Murch | |
| 6,012,442 | A | 1/2000 | Faraj | |
| 6,073,623 | A | 6/2000 | Maschhoff | |
| 6,079,843 | A | 6/2000 | Latella et al. | |
| 6,132,055 | A | 10/2000 | Grisamore et al. | |
| 6,202,640 | B1 | 3/2001 | Naperola et al. | |
| 6,935,327 | B1 * | 8/2005 | Williams et al. | 126/39 BA |
| 7,008,072 | B2 * | 3/2006 | Witzel et al. | 362/92 |

(Continued)

*Primary Examiner*—Ken Rinehart
*Assistant Examiner*—Sarah Suereth
(74) *Attorney, Agent, or Firm*—Warner Norcross & Judd LLP

(57) ABSTRACT

A lighting assembly for a cooking apparatus including a handle, an arm and a light source. The arm is movably joined with the handle so that the arm is selectively movable from a position in which it is concealed at least partially in the handle to another position where the arm projects out from the handle and over a cooking surface when a cover of the cooking apparatus is in an open position. By adjusting the position of the arm, the light source can be aimed at the surface to monitor the cooking of food in low light conditions. In one embodiment, the lighting assembly includes a head, with which the light source is joined, that is movably mounted to the arm to provide an added degree of adjustment for aiming the light source at the cooking surface, and/or a work surface when included.

20 Claims, 6 Drawing Sheets

U.S. PATENT DOCUMENTS

2001/0033484 A1 10/2001 Gilley
2003/0111070 A1 6/2003 DeMars
2006/0160485 A1* 7/2006 Brake et al. ..... 454/293

* cited by examiner

LIGHT FOR COOKING APPARATUS

This application claims benefit to U.S. Provisional Patent Application 60/537,878, filed Jan. 21, 2004, which is hereby incorporated by reference.

BACKGROUND OF THE INVENTION

The present invention relates to a light for a cooking apparatus and, more particularly, to a light for illuminating a cooking surface and/or work surfaces of a barbecue grill.

Over seventy-six percent of households in the United States use barbecue grills. One industry association estimates that approximately sixty-nine percent of gas grill owners use their grills year round as the primary household cooking appliance. It has also been confirmed that many grills are used under low light conditions during evening and nighttime hours. Under such conditions, it is difficult for users to manipulate cooked food or monitor the state of food cooked with the grill.

One attempt to provide light for cooking in low light conditions is disclosed in U.S. Pat. No. 6,132,055 to Grisamore. There, a tube is attached with separate brackets to the lid of a grill. The tube serves as a handle for the lid and also includes bulbs fixedly disposed within the tube, which can illuminate the grill. Although this construction provides illumination, it requires precise alignment of the tube within the brackets, and the lights—which are fixedly positioned in the tube—with the grilling surface.

SUMMARY OF THE INVENTION

The aforementioned problems are overcome in the present invention which provides a lighting assembly for a cooking apparatus including a handle, a movable arm and a light source. The handle is mountable to a cooking apparatus cover and defines a recess. The arm is joined with the handle, and is selectively movable from a position at least partially in the recess to another position projecting over the cooking surface when the cover is in an open position. The light source is joined with the arm and illuminates a cooking surface and/or work surface when the arm is over the cooking surface and/or work surface.

In one embodiment, the lighting assembly can include a head that is movably secured to the arm. The light source can be disposed in or joined with the head. A user can move the head and aim the light source at the cooking surface, surroundings and/or a work surface. The head can be joined with the arm so that when the arm is disposed in the recess of the handle, the head is as well.

In another embodiment, the lighting assembly can include a power interrupt for the light source. The interrupt "breaks" contact between adjacent power sources, e.g. battery cells, thereby cutting power to the light source when the arm is at least partially in the recess. When the arm is removed from the recess and projects over a surface, the interrupt is disabled, the cells achieve electrical communication and power is provided to the light source.

In yet another embodiment, the handle can be formed from a single piece of material to provide an integral, single piece handle, which can be secured to the cover of the cooking apparatus.

In a further embodiment, the arm can be formed from an articulating coil that provides a wide range of lighting configurations to illuminate a cooking surface and/or a work surface.

In yet another embodiment, the lighting assembly can be secured to a cooking apparatus handle with brackets. Such a construction is suitable for add-on lighting applications.

The present invention provides a durable and highly adjustable lighting assembly for a cooking apparatus. When not in use, the light source and arm can be safely stored within the handle of the assembly—out of the way during daytime cooking. Furthermore, with the light source temporarily stored in the handle, it is protected from both damage during daytime cooking and/or excessive smoke residue caused by the light being exposed to the grilling surface during every use of the cooking apparatus. Further, the arm enables the user to focus light on the cooking surface with minimal effort, and without the need to disassemble and reattach the handle to the lid. When the optional movable head is included with the assembly, the light source is even more precisely configurable. Finally, when the optional interrupt is included in the assembly, the opportunity to exhaust the light source power supply is reduced because the light is turned off automatically when the arm is stored away.

These and other objects, advantages and features of the invention will be more readily understood and appreciated by reference to the detailed description of the invention and the drawings.

DETAILED DESCRIPTION OF THE INVENTION

I. Overview

Figure 1:
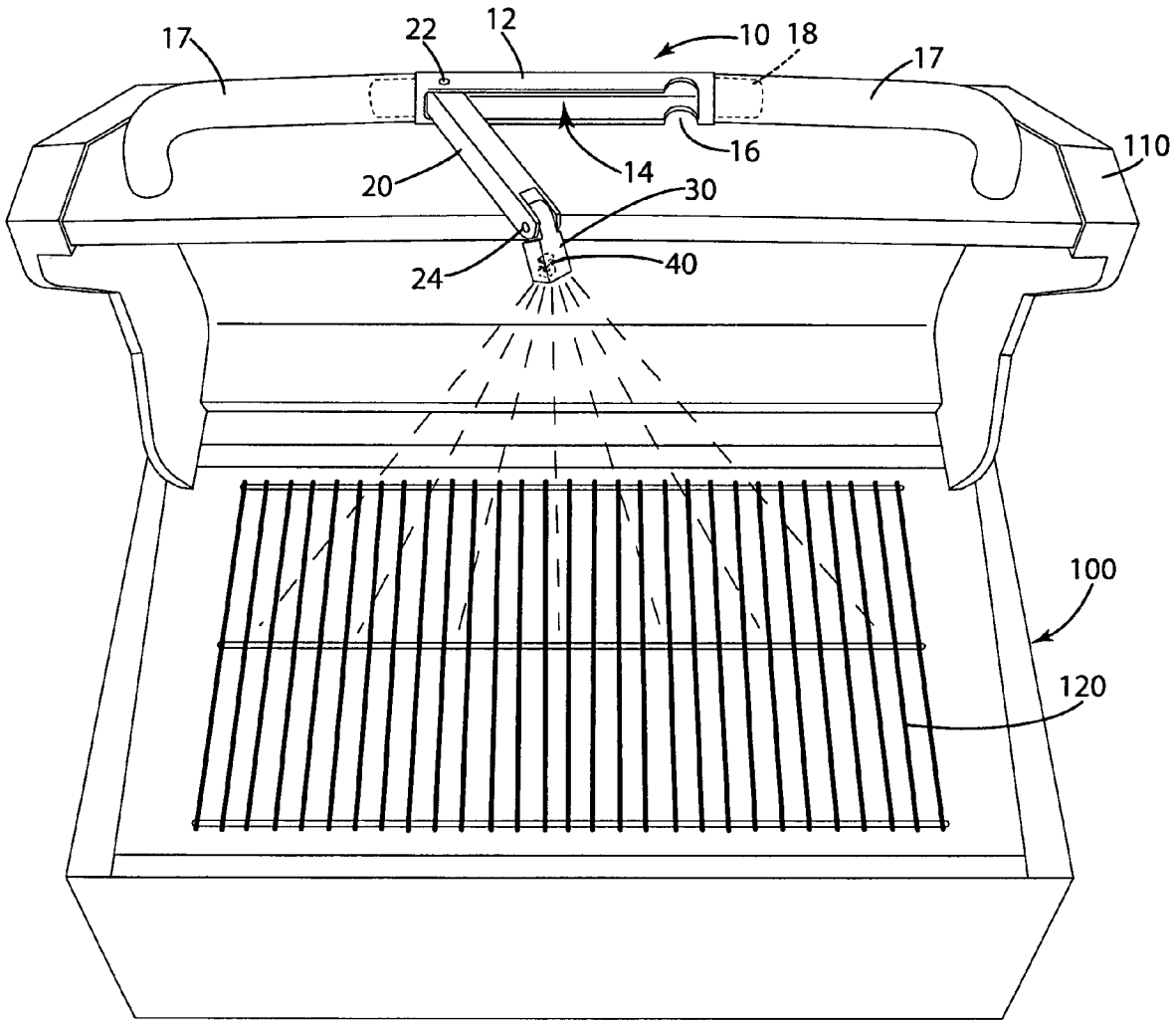
FIG. 1 is a perspective view of the lighting assembly mounted to a cooking apparatus in accordance with an embodiment of the present invention.
Figure 2:
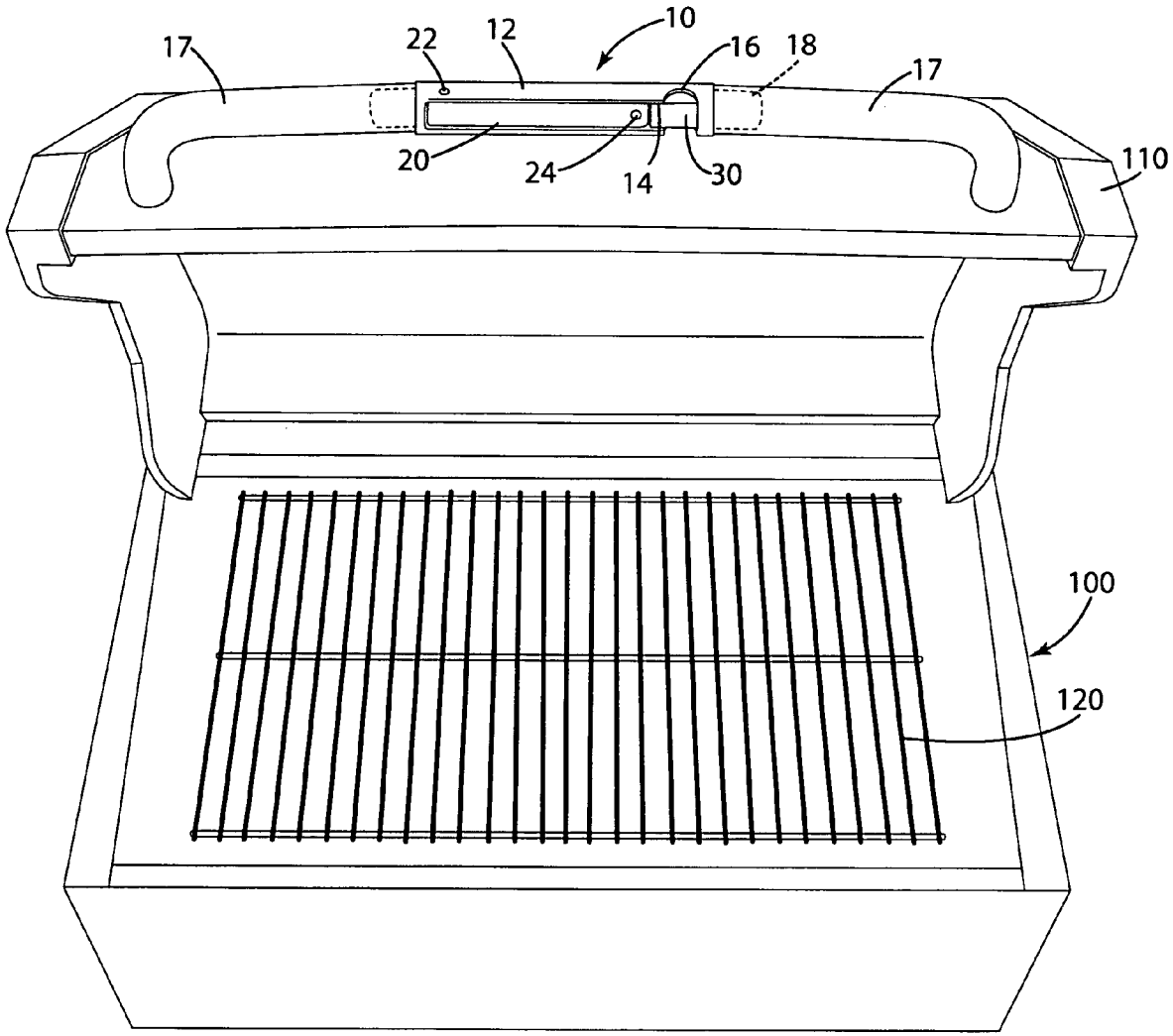
FIG. 2 is a second perspective view of the lighting assembly in a storage configuration.
Figure 3:
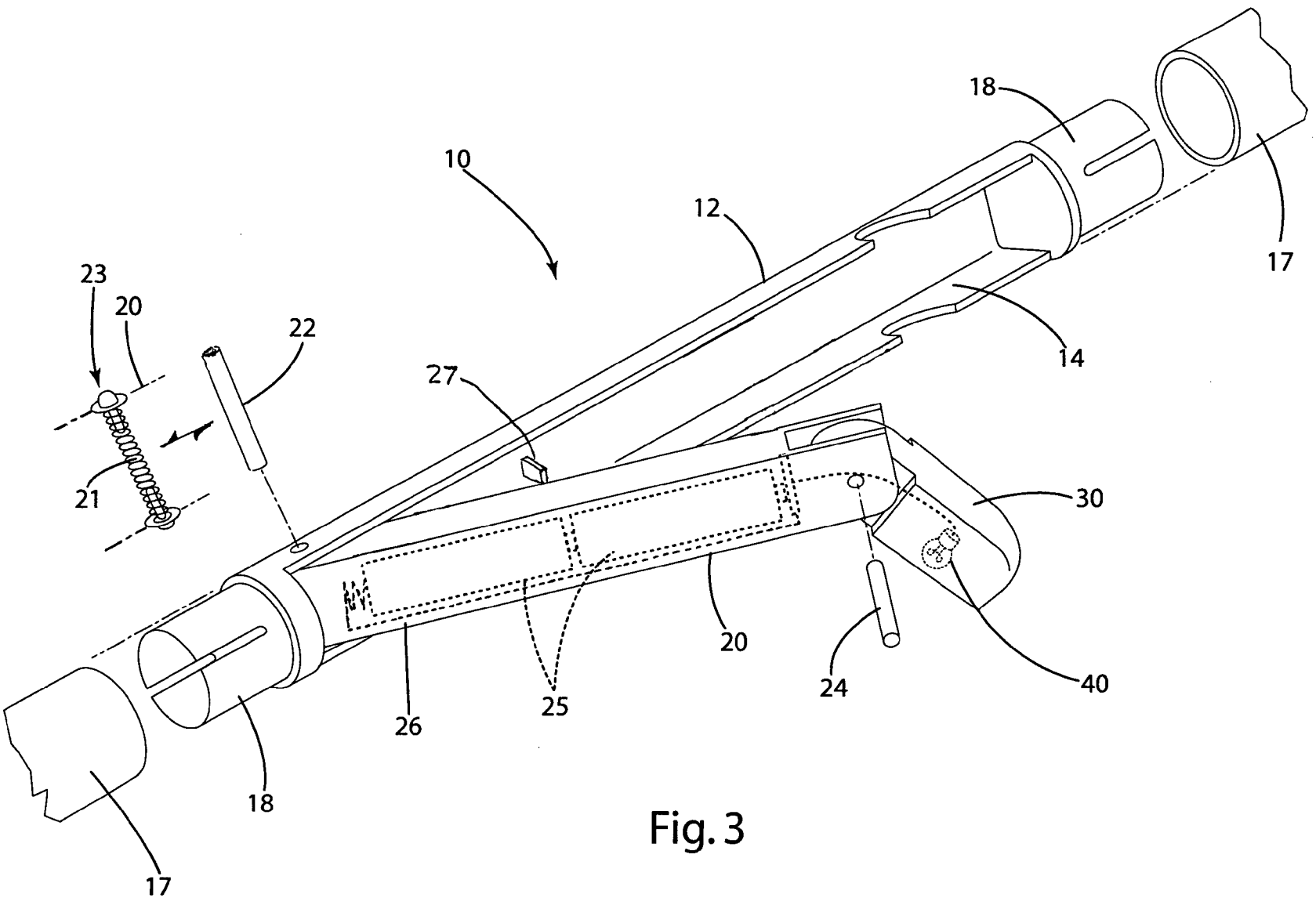
FIG. 3 is a partially exploded view of the lighting assembly.

A lighting assembly for a cooking apparatus incorporating an embodiment of the invention is shown in FIGS. 1–3 and generally designated 10. The lighting assembly 10 is mounted to the cover 110 of the cooking apparatus 100. The lighting assembly 10 includes a handle 12, also referred to as a housing, an arm 20, and a light source 40. As shown in FIG. 1, the arm 20 is in a position so that it extends out from the recess 14 and/or housing 12. Accordingly, the light source 40 can be positioned over the cooking surface 120 and aimed to illuminate that cooking surface. When included, the optional head 30, which moves relative to the arm 20, enables precise aiming of the light source 40 at the cooking surface 120.

Because the arm 20 is movably mounted to the housing 12, when not in use, the arm 20 and light source 40 can be moved to a second position shown in FIG. 2 wherein these components are substantially concealed in the recess 14 of the housing 12. By substantially concealed, it is meant that when the lid 110 is closed, the arm 20 is not readily visible without close inspection. Although the lighting assembly 10 is described in connection with an outdoor barbecue grill 100 herein, it is well suited for a variety of other cooking devices, such as indoor grills, ovens, stoves and the like.

II. Construction

With reference to FIGS. 1–3, the lighting assembly 10 will be described in more detail. The light assembly handle or housing 12 is an elongated, channel-like structure which defines a recess and/or aperture that is open to the environment, i.e. the recess is not covered with another component. The recess is generally elongated and adapted to store the arm 20 and/or head 30 of the light assembly at least partially therein. The housing can further define apertures 16 which enable a user to easily grasp the arm 20 and remove it from the recess 14.

The housing further includes ends 18 which can be of a larger, smaller, or the same cross section as the remainder of the housing 12. Joined with the ends are connectors to form a complete handle for the lid 110. The ends 18 of the housing can fit in or over the ends of the connectors as shown in FIG. 2 or 3. The connectors 17 can be fastened with conventional fasteners, such as bolts, screws, pins, dowels—or even welded or glued to the lid 110. Accordingly, with this construction it is unnecessary to have brackets to attach the completed handle to the lid 110.

The connectors 17 and housing 12, and other components of the light assembly 10, can be constructed from one or multiple pieces of material(s). Suitable materials include, for example, polybutylene terephthalate (PBT), polyethylene terephthalate (PET), polycarbonate (PC), high heat polycarbonate (HPC), polyamide (PA), unsaturated polyester, steel, wood, glass, aluminum, copper, brass, tin or leather. The housing and connectors further can be formed in any practical shape which renders them useful as a handle for raising and lowering the cover 110, for example, an oval, elliptical or other cross section that easily fits the hand of a user.

As shown in FIGS. 1–3, the arm 20 of the lighting assembly is pivotally joined with the housing 12 via pivot pin 22. The pivot pin 22 permits movement of the arm 20 from a position substantially or entirely within the recess to a position that is oblique or substantially perpendicular to the housing 12. In one example, the arm 120 can have a lateral range of movement, from one position to another, of about 10° to about 150°, and optionally about 120°. In this embodiment, the housing 12 and the arm 20 with the light source 40 are separate elements. Alternatively, a ball and socket-type joint can be substituted for the pivot pin configuration. Other joints can be used as well.

As shown in FIG. 3, the pin 22 can be removable so that the arm 20 can be removed from the housing and operate as an independent flashlight. Alternatively, the pin 22 can be substituted with depressible detents 23. These depressible detents can be coupled to a spring 21 and housed within the arm 20. By depressing the detents 23, the arm 20 can be removed and can function as an independent flashlight.

With further reference to FIG. 3, the arm 20 can be constructed from a hollow housing in which a power source 25 (here shown as batteries) can be housed. As such, the housing may include a door (not shown) that is removable so that the power source 25 can be checked or replaced. Various types of batteries, such as alkaline, lithium and nickel-cadmium rechargeable batteries of any size can be used. Other suitable power sources that can be used with the lamp assembly 10 include without limitation, solar cells, thermal cells, and AC and/or DC power connections. Where smaller power sources 25 are utilized, those sources may be housed within the head 30, instead of the arm 20. Alternatively, the power sources 25 can be housed in the housing 12, and/or the connectors 17, or any other component of the assembly 10 or grill 100. An electrical connection can be established between the power source and the light source 40 through the arm 20 and/or head 30. Electrical communication between the power source and light or other components, for example, switches, can be established using wire or other conducting material as the application requires.

To the arm 20, a head 40 can be pivotally joined with another pivot pin 24. The second pivot pin 24 can permit movement of the head from a position substantially aligned with the length of the arm 20 to a plane orthogonal to the plane of movement permitted by the pivot pin 24. In one example, the head can have a range of rotation about the pivot pin 24 of about 45° to about 135°, and optionally about 90°. The head 30 can house a light source 40. The head 30 can be configured so that the light source 40 projects light out any side and/or bottom of the head, depending on the application. More generally, the head 30 is movable relative to the arm 20 so that the light source 40 is aimable at the cooking surface 120 or any other work surface of the grill 100. Although shown joined to the arm 20 with a pivot pin 24, the head 30 may be joined to the arm 20 with a flexible conduit or other connection device.

The light source 40 is in electrical communication with the power source 25 via a conventional connection. The light source 40 can be any light source, for example, a light emitting diode (LED), halogen bulb, HID bulb, an incandescent bulb, or a fluorescent bulb. The light source also can be replaceable relative to the head. Furthermore, multiple light sources can be arranged in proximity to form a cluster, capsule, bulb or other array of light sources. Additionally, a reflector element, for example, parabolic reflector (not shown) may be used in conjunction with the light source to better focus the light on the cooking surface.

The power source 25 and/or light source 40 can be in further electrical communication with a switch mechanism 27. As shown, the switch mechanism can be an interrupt that enables the power source 25 to provide power to light source 40 when the arm is in the open position, i.e., when the arm 20 is swung out away from the handle 12 or moved out of the recess 14. The interrupt can also terminate power to the light source 40 when the arm 20 is seated in the recess 14. More specifically, the interrupt "breaks" contact between adjacent power sources, e.g. battery cells 25, thereby cutting power to the light source 40 when the arm 20 is at least partially in the recess or aperture 40. When the arm is swung out from the recess to project over a surface, the interrupt 27 is disabled, and power is provided to the light source 40. Furthermore, interrupts of any shape or design that interrupt the connection between adjacent cells in a multi-cell power source can be used as desired. Other switches may be suitable for use with the light assembly, for example, toggle, position rocker/push and no-touch switches. Further suitable switches are those which power the light source when the grill cover 110 is raised and/or lowered. Examples of such switches include, for example, limit, proximity, reflective and mercury bulb switches. Any combination of the aforementioned switches may also be used.

III. Operation/Method of Use

Operation of the lighting assembly to cook with the cooking apparatus 100 in low light conditions will now be described in connection with FIGS. 1–3. In general, the outdoor grill 100 is usually prepared by a user for cooking. To do so, the user opens the cover 110 by grasping the handle 12 and/or connectors 17. The user moves the handle 12 so that the cover 110 opens and exposes the cooking surface 120. The user grasps the arm 20. When included, the aperture 16 may facilitate grasping of the arm with the user's fingertips. The user then moves the arm 20 outward from the recess 14 to a position so that the arm projects outward from the housing and/or recess, preferably over the cooking surface 120 and/or over a working surface when included. In so doing, the arm 20 pivots about the pivot pin 22 or other attachment mechanism. Additionally, when included, the interrupt 27 establishes electrical communication between the power source 25 and the light source 40 so that the light source 40 illuminates as described above. When included, the user can adjust the head 30 of the lighting assembly, i.e. aim it at the cooking surface 120 and/or any other work surface of the grill, by moving the head 30 relative to the arm 20. After the user determines the light source 40 sufficiently illuminates the cooking surface 120, the user may begin or resume cooking on the cooking surface 120, or begin or resume work on the work surface.

IV. First Alternative Embodiment

Figure 4:
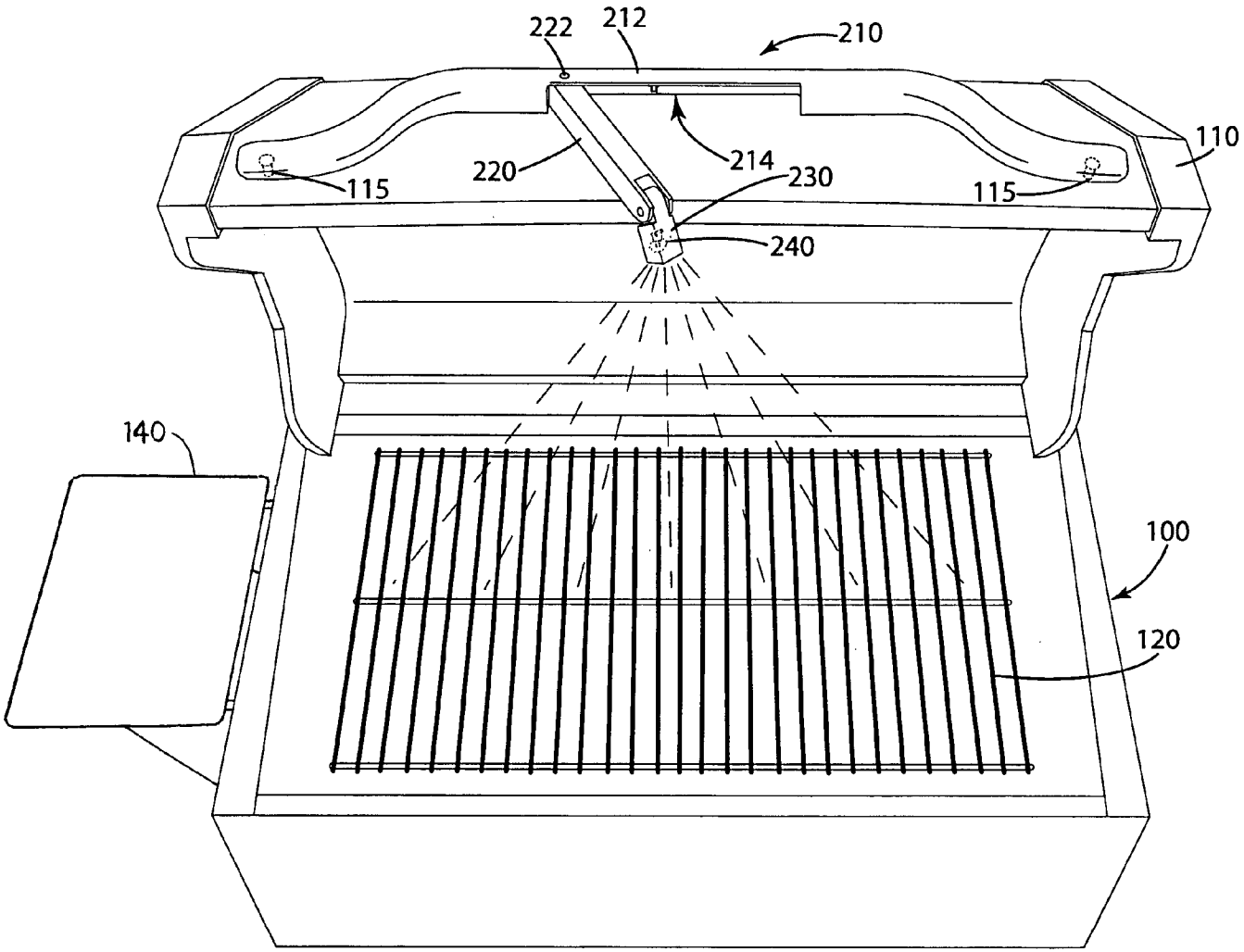
FIG. 4 is a first alternative embodiment of the lighting assembly including an integral handle housing.

A first alternative embodiment of the light assembly is shown in FIG. 4 and generally designated 210. This lighting assembly includes an arm 220, head 230 and light source 240 as described in the embodiment above. These components operate in a similar manner and swing out from the recess 214 and/or in the housing 212. The housing 212 is slightly different from that above in that the housing is lengthened on both sides of the recess 214, and contoured so that it attaches directly to the cover 110 of the grill 100. In this embodiment, the housing can be formed of a plastic material to form an integral, single-piece handle which houses a separate and independent light. Fasteners 115 can fasten the lighting assembly 210 directly to the cover 110. Such fasteners can be screws, bolts, or rivets that are passed through holes (not shown) in the cover and secured to the housing 214. Additionally, the housing of this embodiment can include a recess 214 that is slightly different than that described above. Specifically, the recess may be L-shaped, so that it conceals the arm 220 and head 230 only on the upper and front portions of those elements. In this embodiment, the housing can be of any cross section that facilitates ease of use. Furthermore, with this construction, it is unnecessary to include additional components or brackets to secure the handle 210 to the cover 110. Finally, in this embodiment, a work surface 140 is included with the grill 100. As with all embodiments herein, the light source 240 can be aimed at the working surface 140 and/or the cooking surface 120 with the lighting assembly to illuminate those surfaces.

V. Second Alternative Embodiment

Figure 5:
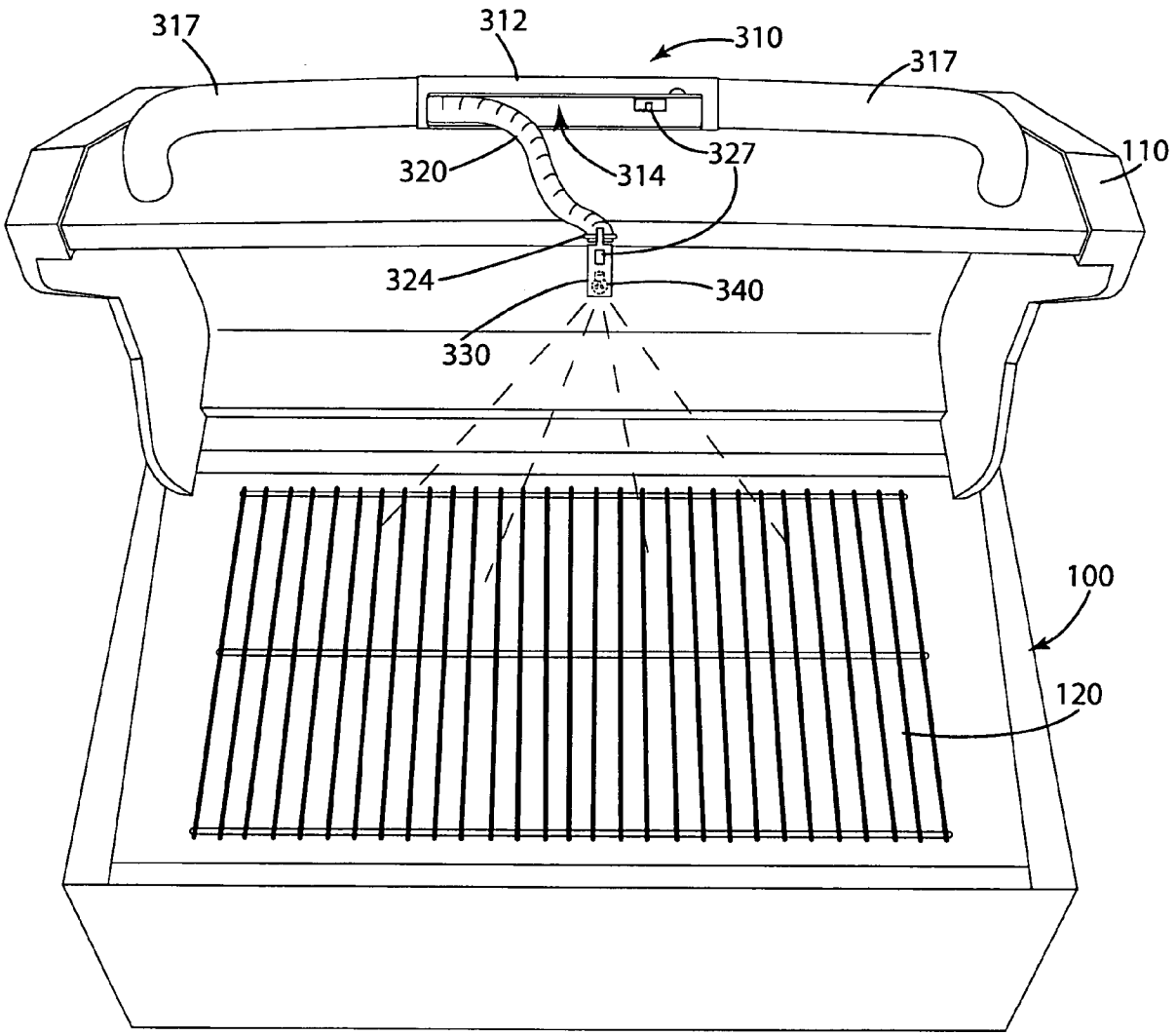
FIG. 5 is a second alternative embodiment of the lighting assembly including an alternative arm structure.

With reference to FIG. 5, a second alternative embodiment of the lighting assembly, generally designated 310, will now be described. In this embodiment, the components of the lighting assembly are generally the same as that described in the first embodiment above, however, the arm 320 is constructed in the form of a flexible conduit. With this configuration, the arm 320 can be removed from the recess 314 and "snaked" into position so that the light source 340 illuminates the cooking surface 120. Optionally, the head 340 may be pivotally or movably joined with the end of the arm 320 to offer a greater degree of movement. Alternatively, the head 330 can be non-movably secured to the end of the arm 320 in a conventional manner.

In this embodiment, the light source 340 can be powered by a power source disposed in the head 330 or the housing 312, the power source being in electrical communication with the light source 340 as desired. Furthermore, in this configuration, a switch 327, for example, an interrupt, can be joined with the head 330 and the housing 312 as desired. Other types of switches can be used as desired.

V. Third Alternative Embodiment

Figure 6:
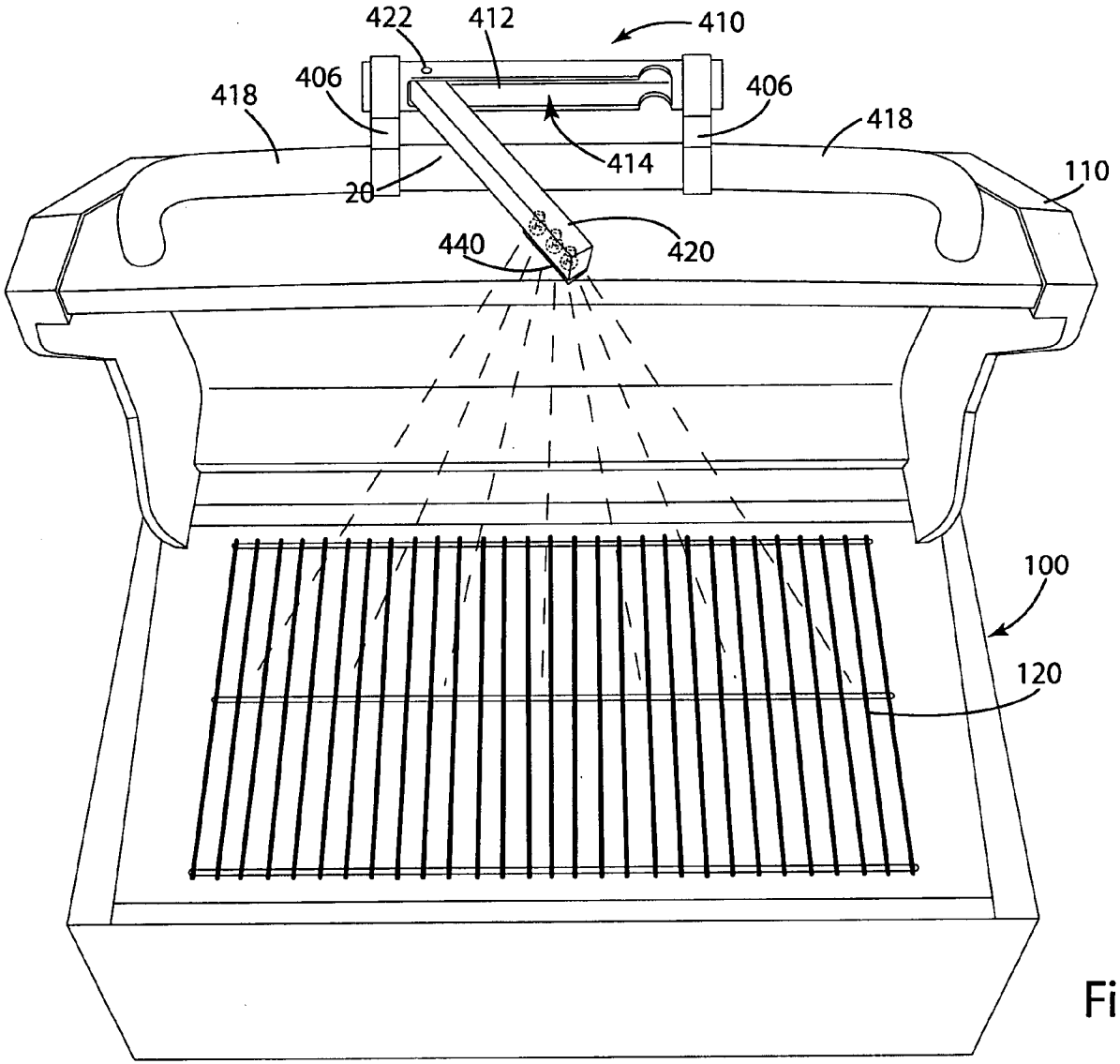
FIG. 6 is a third alternative embodiment of the lighting assembly in an add-on configuration.

With reference to FIG. 6, a third alternative embodiment of the lighting assembly of the present invention, generally designated 410, will now be described. The components and features of the lighting assembly shown in FIG. 6 are generally the same as the above embodiments, and operate under the same general principals. However, the lighting assembly 410 can be connected with brackets 406 to a handle 118, which is further connected to the cover 110. In this embodiment, the lighting assembly 410 is therefore held above, and is separate from, the handle 118. The brackets may be of any conventional construction. An additional difference between this embodiment and the previous is that the arm 420 houses the light source 440, and a separate head for the light source is absent. Additionally, the light source 440 may be comprised of multiple bulbs or an array of different light sources as shown.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The embodiments of the invention in which an exclusive property or privileg is claimed are defined as follows:

1. A cooking apparatus comprising:

a cooking surface;

a cover pivotable about a substantially horizontal axis to an open position wherein the cooking surface is exposed, and to a closed position wherein the cooking surface is substantially concealed;

a housing joined with the cover, the housing defining a downwardly opening recess, the housing operable as a handle to manipulate the cover to the open position and to the closed position;

an arm pivotally mounted to the housing, the arm selectively movable to a first position wherein the arm is disposed at least partially in the downwardly opening recess, and to a second position wherein the arm pivots out from the recess to a location above the cooking surface when the cover is in the open position, the arm being selectively movable by a user, separate and independent of the cover pivoting to the open position; and a head including a light source, the head selectively moveable relative to the arm so that the light source aims at the cooking surface when the cover is in the open position, and so that the head is disposed at least partially in the downwardly opening recess when the arm is in the first position, wherein the arm, head and light source are substantially concealed from view when the arm is in the first position, the cover is closed and the housing is viewed from above or in front of the cover by a viewer.

2. The cooking apparatus of claim 1 comprising a pivot pin projecting through the housing, the recess and the arm wherein the arm pivots about the pivot pin.

3. The cooking apparatus of claim 2 wherein the power source is located in the arm.

4. The cooking apparatus of claim 3 comprising an interrupt that enables the power source to provide power to the light source when the arm is in the second position.

5. The cooking apparatus of claim 4 wherein the interrupt terminates the power when the arm is in the first position.

6. The cooking apparatus of claim 1 comprising an interrupt that enables the power source to provide power to the light source when the arm is in the second position, and to terminate power when the arm is in the first position.

7. The cooking apparatus of claim 1 wherein the arm pivots about a first axis, and wherein the head pivots about a second axis that is substantially perpendicular to the first axis.

8. The cooking apparatus of claim 1 comprising a tubular element that is graspable as a handle, the tubular element joined with the housing and the cover.

9. The cooking apparatus of claim 1 wherein the housing forms a single-piece handle, the handle including a fastener receiver that receives a fastener which enables the single piece handle to be joined with the cover.

10. A lighting assembly for a cooking apparatus including a cooking surface and a cover comprising:

a housing defining a downwardly opening elongated recess that is open to the environment, the housing including an end;

a connector joined with the end and further joined with at least one of the cover, a bracket joined with the cover, and a handle joined with the cover to hold the housing in a fixed position relative to the cover;

an arm joined with the housing, the arm selectively movable to a first position wherein the arm is at least partially in the downwardly opening recess and substantially concealed from view by the housing when the housing is viewed by a user from in front of or above the cover when the cover is in a closed position, and a second position wherein the arm projects out from the recess and over the cooking surface when the cover is in an open position, the arm being selectively movable by a user independent and separate from movement of the cover; and a light source joined with the arm, the light source illuminating the cooking surface when the arm is in the open position.

11. The lighting assembly of claim 10 comprising a pivot member positioned through the housing; the recess and the arm so that the arm pivots about the pivot member to the first and second positions.

12. The lighting assembly of claim 10 comprising an interrupt electrically coupled to the light source, the interrupt providing power to the light source when the arm is in the second position, but providing no power to the light source when the arm is in the first position.

13. The lighting assembly of claim 12 wherein the arm pivots about a first axis and the light pivots about a second axis that is substantially perpendicular to the first axis.

14. The lighting assembly of claim 12 wherein the connector is mounted to a handle joined with the cover.

15. The lighting assembly of claim 10 comprising a head, the light source disposed at least partially in the head, wherein the grill includes a work surface, wherein the head is moveably mounted to the arm so that the light source is aimable toward at least one of the cooking surface and the work surface.

16. A lighting assembly for a cooking apparatus including a cooking surface and a cover comprising:

a handle defining an aperture that opens downwardly to the environment, the handle joined with the cover;

a pivot element joined with the handle;

an arm joined with and pivot element, the arm selectively pivotable about the pivot element to a first position wherein the arm is substantially concealed in the handle, when the handle is viewed by a user in front of or above the cover when the cover is closed, and to a second position wherein the arm projects out from the handle aperture and over the cooking surface when the cover is in an open position, the arm being selectively pivotable by a user independent and separate from movement of the cover;

a head including a light source, the head moveably mounted to the arm so that the head is adapted to position over the cooking surface and so that the light source is adapted to aim at the cooking surface when the arm is in the second position; and a power source coupled to and powering the light source when the light source is aimed at the cooking surface.

17. The lighting assembly of claim 16 comprising an interrupt that enables the power source to power the light source when the arm is in the second position, but not power the light source when the arm is in the first position.

18. The lighting assembly of claim 16 wherein the pivot element projects through the housing, the recess and the arm, from one side of the housing to another side of the housing.

19. A method for preparing an outdoor grill, which includes a cooking surface and a cover, for cooking food comprising:

gasping a handle, the handle being joined with an arm that is substantially concealed in a downwardly opening recess defined by the handle, the arm selectively movable relative to the housing, the arm being further joined with a light source, the arm being substantially concealed from view when the handle is viewed from above or in front of the cover by a viewer;

moving the handle to open the cover and expose the cooking surface to the environment;

moving the arm relative to the handle, about a first axis out of the recess after the handle moving step, so that at least a portion of the arm projects outward from the handle to a position over the cooking surface, the light source moving with the arm;

moving the light source about a second axis that is substantially perpendicular to the first axis; and aiming the light source at the cooking surface so that the light source illuminates the cooking surface.

20. The method of claim 19 wherein the light source is included in a head that pivots relative to the arm, and wherein said aiming includes pivoting the head relative to the arm.

* * * * *